US007077767B2

(12) United States Patent
Mauser et al.

(10) Patent No.: US 7,077,767 B2
(45) Date of Patent: Jul. 18, 2006

(54) RACKET FOR BALL GAMES AND PRODUCTION PROCESS

(75) Inventors: Johannes Mauser, Bregenz (AT); Klaus Rambach, Peiting (DE); Manfred Emberger, Lochau (AT); Johan Kotze, Bregenz (AT); Herfried Lammer, Lauterach (AT)

(73) Assignee: Head Technology GmbH, Kennelbach (AT)

( * ) Notice: Subject to any disclaimer, the term of this patent is extended or adjusted under 35 U.S.C. 154(b) by 0 days.

(21) Appl. No.: 10/812,059

(22) Filed: Mar. 30, 2004

(65) Prior Publication Data

US 2005/0197218 A1 Sep. 8, 2005

(30) Foreign Application Priority Data

Mar. 3, 2004 (DE) ..... 10 2004 010 349

(51) Int. Cl.
*A63B 49/02* (2006.01)

(52) U.S. Cl. ..... 473/521; 473/536; 473/537

(58) Field of Classification Search ..... 473/520, 473/521, 524, 535–537, 547
See application file for complete search history.

(56) References Cited

U.S. PATENT DOCUMENTS 4,609,198 A 9/1986 Tarr
5,174,568 A * 12/1992 You ..... 473/521
5,314,180 A * 5/1994 Yamagishi et al. ..... 473/521
5,700,210 A * 12/1997 Takechi et al. ..... 473/535
5,928,090 A 7/1999 Cabales et al.
6,416,432 B1 * 7/2002 Rosen et al. ..... 473/524
6,422,958 B1 * 7/2002 Repetto et al. ..... 473/536
6,663,515 B1 * 12/2003 Pai ..... 473/521
2002/0058557 A1 5/2002 Kanemitsu
2003/0036448 A1 2/2003 Severa et al.
2003/0073522 A1 * 4/2003 Hsu ..... 473/535
2003/0073523 A1 * 4/2003 Hsu ..... 473/535
2005/0003912 A1 * 1/2005 Ashino et al. ..... 473/535
2005/0119075 A1 * 6/2005 Ashino ..... 473/535

FOREIGN PATENT DOCUMENTS

EP 0 441 971 B2 2/1996
WO WO 03/057322 A2 7/2003
WO WO 03/057322 A3 7/2003

* cited by examiner

*Primary Examiner*—Raleigh W. Chiu
(74) *Attorney, Agent, or Firm*—Finnegan, Henderson, Farabow, Garrett & Dunner LLP

(57) ABSTRACT

The present invention relates to a racket for ball games, in particular a tennis racket, squash racket, badminton racket, racquet ball racket or paddle tennis racket comprising a frame consisting of a racket head and a handle portion connected thereto and being formed of a hollow profile. The hollow profile is formed by winding a plurality of web-like layers. On the racket head and/or in the heart region, the racket comprises at least one dampening layer being wrapped between the layers forming the hollow profile. The racket thus exhibits excellent dampening characteristics and can effectively minimize shock and/or vibration.

22 Claims, 1 Drawing Sheet

RACKET FOR BALL GAMES AND PRODUCTION PROCESS

Figure 1A:
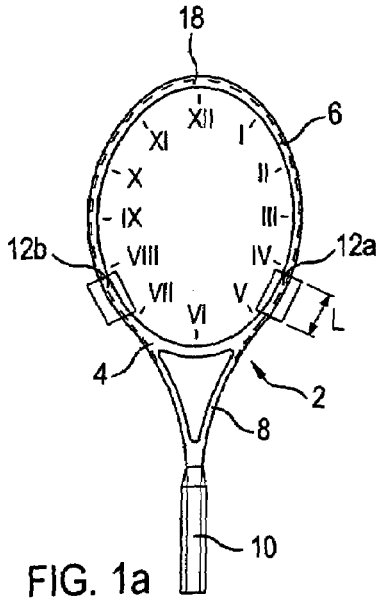

The present invention relates to a racket for ball games, in particular a tennis racket, squash racket, badminton racket, racquet ball racket or paddle tennis racket having excellent handling properties, as well as a process for producing such a racket.

Rackets of this kind typically have a frame forming a racket head and a grip or handle portion connected thereto. A so-called heart region is typically formed in the transition area between the racket head and the handle portion. The frame is usually formed of a frame profile or hollow profile which is produced of a carbon fiber reinforced plastics material in a molding press. The racket head of the racket defines a stringing plane in which the stringing of the racket is arranged. For receiving the individual strings of the stringing, through holes through which the individual strings can be passed are provided on the frame in the stringing plane.

When a racket of this kind strikes a ball, both shock and vibration caused by the ball contact are transferred from the head portion of the racket through the handle portion to the player's arm. This can cause discomfort and can possibly lead to physical problems (e.g. tennis elbow).

Many prior attempts have been made to reduce the transmission of shock and vibration to the player's arm. For example, U.S. Pat. No. 4,609,198 describes a racket in which a tubular damping pad is positioned within the grip of the racket. A more recent attempt to reduce the transmission of shock and vibration to the player's arm is described in US-A-2003/0036448. This racket comprises separate head and handle portions. The head portion and handle portion are joined with a shock and/or vibration absorbing material such as urethane or rubber which reduces the transmission of shock and vibration from the head portion to the handle portion. Accordingly, this racket is based on the consideration not to provide a direct connection between the head portion and the handle portion through which shock and vibration can be transmitted. In other words, this racket is divided in three parts, namely a head portion, a connecting region and a handle portion.

It is the object of the present invention to provide an improved ball game racket having excellent shock and vibration dampening characteristics. This object is achieved with a racket comprising the features of independent claim 1. The dependent claims describe preferred embodiments of the racket of the present invention. Independent claim 18 relates to a process for producing the racket of the present invention. The claims depending thereon relate to advantageous embodiments of the process of the present invention.

The ball game racket of the present invention comprises a frame which has a racket head and a handle portion being connected thereto via a heart region. The frame is formed as a hollow profile by winding a plurality of sheet material layers. On the racket head and/or in the heart region of the racket of the present invention there is at least one dampening layer wrapped between the layers forming the hollow profile.

The term "dampening layer" indicates that the material concerned is a shock and/or vibration absorbing material such as, e.g., rubber and/or synthetic rubber. Preferred materials are polyisoprene, styrene-butadiene rubber, polychloroprene or urethane rubber. The hardness of the material forming the dampening layer is preferably greater than 30 Shore A, particularly preferably the hardness is within the range of about 65 and 75 Shore A, in particular at about 70 Shore A.

A racket of the present invention preferably comprises a plurality of dampening layers which are arranged in pairs and essentially symmetrical with respect to the longitudinal axis of the racket. For defining positions on the racket head, usually the dial of a clock is used, wherein the twelve o'clock position (XII) is located at the outermost free end of the racket head, i.e. on the end opposite the handle portion. The three o'clock position and nine o'clock position are accordingly located approximately in the middle of the overall length of the racket head (cf. FIG. 1*a*).

The at least one dampening layer is preferably arranged in the area between four o'clock and six o'clock, in particular at about five o'clock, and/or in case of a second dampening layer, essentially symmetrical with respect thereto between six o'clock and eight o'clock, in particular at about seven o'clock. It is particularly preferred to arrange the dampening layers in pairs in the area between four o'clock and six o'clock, in particular at about five o'clock and, opposite thereto, between six o'clock and eight o'clock, in particular at about seven o'clock. Moreover, it can be advantageous to provide on the racket head a further pair of dampening layers in the area between one o'clock and three o'clock, in particular at about two o'clock and/or between nine o'clock and eleven o'clock, in particular at about ten o'clock. The dampening layer preferably consists of a sheet-shaped or web material having suitable dimensions as regards length, width and thickness, wherein the dampening material is preferably a rectangular piece of web material.

The dampening material preferably has a thickness ranging between 0.05 mm and 0.3 mm, more preferably between 0.15 mm and 0.25 mm, most preferably a thickness of about 0.2 mm.

The width of the dampening material, i.e. its extension in the winding direction, is preferably dimensioned such that in the wound condition the dampening material extends over at least one, preferably two or more windings in the cross-section of the frame profile in order to form the dampening layer. For this purpose, the dampening material has preferably a width ranging between 30 mm and 150 mm, more preferably between 70 mm and 140 mm, most preferably between 80 mm and 130 mm. The width and thickness of the dampening material are preferably selected such that for each wall of the frame profile of a finished frame the sum of the thicknesses of the individual layers of dampening material is preferably within the range of about 0.1 mm to 0.6 mm, preferably 0.3 mm to 0.5 mm.

The length of the dampening layer along the frame profile preferably ranges between 20 mm and 150 mm, more preferably between 40 mm and 110 mm.

The dimensions of the dampening material are preferably selected in accordance with the size of the impact or striking surface and/or the circumference of the frame profile in the area of the dampening layer. In a racket having a striking surface of about 760 $cm^2$ or an inner circumference of the racket head of about 992 mm, the dampening material has preferably a length along the frame of 90 mm to 130 mm, preferably of 105 mm to 115 mm, more preferably of about 110 mm. The width of the dampening material in the winding direction is within the range between about 110 mm and 150 mm, preferably between 125 mm and 135 mm, more preferably at about 130 mm. In the case of a frame height of about 28 mm to 30 mm and a circumference of the frame profile in the area of the dampening layer (at four o'clock) of about 71 mm, at least one, preferably two to three winding(s) can be realized with the dampening material having the above dimensions.

In a racket having a striking surface of about 660 $cm^2$ or an inner circumference of the racket head of about 925 mm, the dampening material has, e.g., a length along the frame of 60 mm to 100 mm, preferably of 75 mm to 85 mm, more preferably of about 80 mm. The width of the dampening material in the winding direction is within the range between about 60 mm and 100 mm, preferably between 75 mm and 85 mm, more preferably at about 80 mm. In the case of a frame height of about 21 mm to 25 mm and a circumference of the frame profile in the area of the dampening layer (at four o'clock) of about 69 mm, at least one, preferably one to two winding(s) can be realized with the dampening material having the above dimensions.

In a racket having a striking surface of about 600 $cm^2$ or an inner circumference of the racket head of about 866 mm, the dampening material has, e.g., a length along the frame of 20 mm to 60 mm, preferably of 35 mm to 45 mm, more preferably of about 40 mm. The width of the dampening material in the winding direction is within the range between about 60 mm and 100 mm, preferably between 75 mm and 85 mm, more preferably at about 80 mm. In the case of a frame height of about 19 mm and a circumference of the frame profile in the area of the dampening layer (at four o'clock) of about 50 mm, at least one, preferably two winding(s) can be realized with the dampening material having the above dimensions.

A further advantageous way of forming the dampening layer is to provide a plurality of dampening material strips which are advantageously arranged in parallel. The strips may be wound such that they partially overlap at least in the edge regions, wherein the material forming the frame (e.g. carbon fiber layers) is arranged therebetween. The width of the strips preferably ranges between 3 mm and 10 mm, more preferably between 5 mm and 7 mm. By means of these strips the shock and/or vibration energy can also be absorbed effectively in order to guarantee excellent dampening characteristics, wherein at the same time weight can be saved.

The invention furthermore relates to a process for producing a racket. For this process, first a windable layer material, e.g. carbon webs, is provided, and a web-shaped dampening material is placed on said layer material. Then, the layer material, together with the dampening material which is at least partially arranged thereon, is wound to become a tube which is then molded to become the frame profile forming the frame. A molding press into which the tube is placed and then molded under the influence of pressure and temperature is normally used for this purpose. The thus formed frame comprises a racket head and a handle portion connected thereto via a heart region, wherein at least one dampening layer being wrapped between the layers forming the hollow profile is provided on the racket head and/or in the heart region.

The racket of the present invention is particularly advantageous in that it exhibits excellent dampening characteristics. At the same time, the racket can be produced in a relatively simple and therefore cost-saving manner.

Figure 1B:
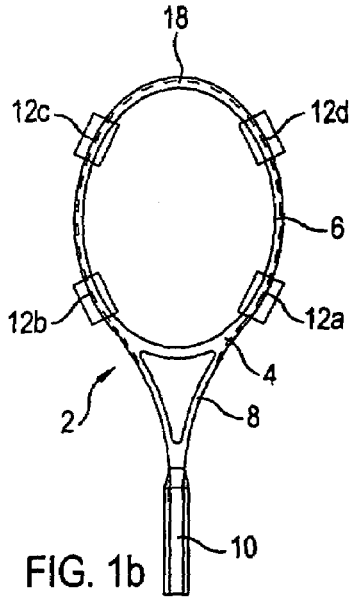
Figure 3:
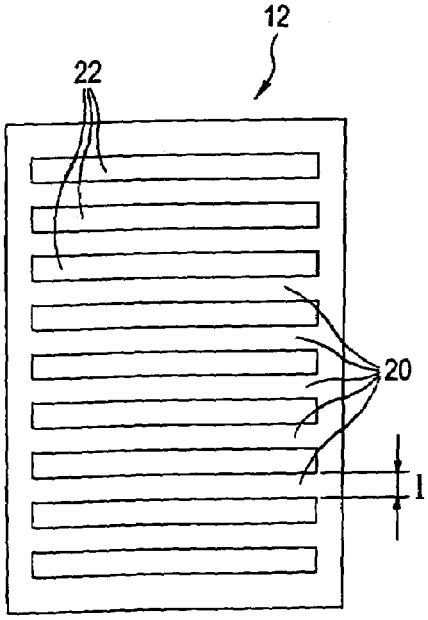
Figure 2:
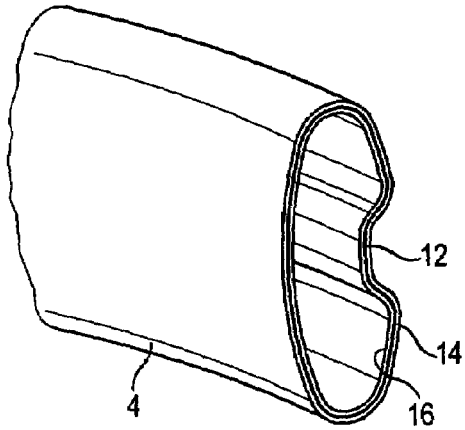

Preferred embodiments of the racket of the present invention will be described in the following on the basis of the drawings in which FIG. 1*a* shows a schematic front view of a racket of the present invention in which preferred positions of the dampening layers are shown;

FIG. 1*b* shows a view similar to that of FIG. 1*a*, wherein two pairs of dampening layers are provided in this embodiment of the racket of the present invention;

FIG. 2 shows a perspective sectional view through the frame profile of a racket of the present invention; and FIG. 3 shows a schematic representation of a dampening material consisting of a plurality of strips.

The racket 2 of the present invention is formed of a frame 4 and comprises a racket head 6 and a handle portion 10 being connected thereto via a heart region 8.

As shown in FIG. 2, the frame 4 is formed of a hollow profile which is produced by winding a plurality of layers. At first flexible web-like materials, e.g. carbon webs, are normally used for this purpose, wherein said webs are normally stacked under an angle of ±45° with respect to the frame direction. The stacked materials are wound or rolled to become a "tube", so that a plurality of web material windings lie on top of each other. This tube is then molded in a molding press under the influence of pressure and temperature to become a hollow profile forming the frame.

According to the invention, the racket 2 comprises at least one dampening material which is wrapped between the layers forming the hollow profile and forms a dampening layer 12 in the finished racket as shown in FIG. 2. The dampening layer 12 is arranged between two neighboring layers 14 and 16 of the web material forming the frame. Thus, the shear or tangential stress occurring between the individual layers 14 and 16 can effectively be compensated by the dampening material.

According to the embodiment shown in FIG. 1*a*, the racket 2 comprises a pair of dampening layers 12*a*, 12*b* which are arranged essentially symmetrical with respect to the longitudinal axis of the racket 2. As shown in FIG. 1*a*, the dampening layer 12*a* is located approximately in the area between four o'clock and six o'clock. It is particularly preferred to arrange the dampening layer 12*a* at about five o'clock. The dampening layer 12*b*, which is arranged symmetrical with respect to the dampening layer 12*a*, is located approximately in the area between six o'clock and eight o'clock. It is particularly advantageous to provide the dampening layer 12*b* at about seven o'clock on the racket head.

In the embodiment of the racket 2 of the present invention as shown in FIG. 1*b*, two pairs of dampening layers are provided on the racket head 6. The first pair of dampening layers 12*a*, 12*b* is arranged in accordance with the embodiment of FIG. 1*a*. The second pair of dampening layers 12*c*, 12*d* is arranged closer to a free end 18 of the racket head 6. The dampening layer 12*c* is preferably located approximately in the area between nine o'clock and eleven o'clock, wherein a position at about 10 o'clock is particularly preferred. The dampening layer 12*d* is preferably arranged between one o'clock and three o'clock, particularly preferably at about two o'clock.

The dampening material preferably has a thickness ranging between 0.05 mm and 0.3 mm, more preferably between 0.15 mm and 0.25 mm, and particularly preferably at about 0.2 mm. The width of the dampening material in the winding direction is preferably dimensioned such that the dampening layer 12 extends at least once around the circumference of the hollow profile forming the frame 4, i.e. comprises at least one winding. However, more preferably the width should be dimensioned such that the dampening material extends around at least two windings. For this purpose, the width of the dampening material preferably ranges between 30 mm and 150 mm, more preferably between 70 mm and 140 mm, and most preferably between 80 mm and 130 mm. The length L of the dampening layer 12 in the frame direction preferably ranges between 20 mm and 150 mm, more preferably between 40 mm and 110 mm. According to the embodiment schematically shown in FIG. 3, the dampening material can also be provided in the form of a plurality of strips 20. The strips 20 are preferably arranged parallel with respect to each other and together form a dampening layer 12, the dimensions of which preferably lie within the ranges of the continuous dampening layer described above. As shown in FIG. 3, the strips 20 of the dampening layer 12 are preferably formed in that a plurality of parallel openings 22 are cut out from an approximately rectangular piece of the dampening material. Thus, strips 20 are formed which are arranged parallel with respect to each other and are connected with each other along the circumference of the rectangle. This dampening material 12 can therefore also be used as an integral element.

The individual strips 20 preferably have a length l within the range between 3 mm and 10 mm, more preferably between 5 mm and 7 mm. The effect of an improved dampening according to the invention is also guaranteed with this dampening layer 12 which is formed of strips because the individual strips 20 also reduce the shear or tangential stress occurring between neighboring layers 14, 16. The individual strips can be provided perpendicular with respect to the frame direction on the corresponding position. It can also be advantageous to provide the strips 20 under an angle relative to the winding direction so that in the wound state neighboring strips can overlap at least partially. Suitable angles for winding the dampening material preferably range between 0° and 45°, preferably between 5° and 15° with respect to the longitudinal direction of the frame. Also with this arrangement shear or tangential stress between neighboring layers 14, 16 of the layer material forming the frame 4 are effectively reduced.

The racket 2 of the present invention is particularly advantageous in that, despite its integral or one-piece construction, it exhibits excellent dampening characteristics and can at the same time be produced in a simple manner.

The invention claimed is:

1. A racket for ball games including a frame having a racket head and a handle portion connected to the racket head via a heart region, wherein the frame is formed of a hollow profile formed by winding a plurality of layers, wherein a plurality of discrete dampening layers are arranged in pairs and essentially symmetrical with respect to the longitudinal axis of the racket, wherein a dampening layer is provided in an area between four o'clock and six o'clock and a further dampening layer in an area between six o'clock and eight o'clock on the racket head, and wherein the dampening layers are wrapped between the plurality of layers forming the hollow profile.

2. The racket according to claim 1, wherein a dampening layer is provided at about five o'clock and a further dampening layer at about seven o'clock on the racket head.

3. The racket according to claim 1, wherein a dampening layer is provided in the area between one o'clock and three o'clock and a further dampening layer between nine o'clock and eleven o'clock on the racket head.

4. The racket according to claim 1, wherein a dampening layer is provided at about 2 o'clock and a further dampening layer at about ten o'clock on the racket head.

5. The racket according to claim 1, wherein the dampening layer is formed of a material that is one or both of a shock absorbing material and a vibration absorbing material.

6. The racket according to claim 1, wherein the at least one dampening layer formed of a material comprising synthetic rubber.

7. The racket according to claim 1, wherein the material of the at least one dampening layer has a thickness ranging between 0.05 mm and 0.3 mm.

8. The racket according to claim 1, wherein the width of the material of the at least one dampening layer is dimensioned such that the dampening layer extends over a winding in the hollow profile.

9. The racket according to claim 1, wherein the material forming the at least one dampening layer has a width ranging between 30 mm and 150 mm.

10. The racket according to claim 1, wherein the at least one dampening layer has a length (L) ranging between 20 mm and 150 mm.

11. The racket according to claim 1, wherein the dampening material has a Shore A hardness greater than 30.

12. The racket according to claim 1, wherein the dampening layer is provided under an angle ranging between 0° and 45° with respect to the longitudinal direction of the frame.

13. The racket according to claim 1, wherein at least one dampening layer is provided in the heart region of the racket.

14. The racket for ball games including a frame having a racket head and a handle portion connected the racket head via a heart region, wherein the frame is formed of a hollow profile formed by winding a plurality of layers, wherein at least one dampening layer is included on or in one or both of the racket head and the heart region, wherein the at least one dampening layer is wrapped between the plurality of layers forming the hollow profile, and wherein the at least one dampening layer is provided in the form of a plurality of strips.

15. The racket according to claim 14, wherein the strips extend essentially parallel with respect to each other.

16. The racket according to claim 14, wherein each strip has a length ranging between 3 mm and 10 mm.

17. A process for producing a racket comprising the following steps:

(a) providing a layer material that is windable;

(b) placing a sheet of dampening material onto the layer material, such that the materials are at least partially overlapping;

(c) winding the at least partially overlapping layer material and dampening material to form a tube; and (d) forming a frame consisting of a frame profile made of the tube, wherein the frame comprises a racket head and a handle portion being connected with the racket head via a heart region;

wherein the frame comprises a plurality of discrete dampening layers arranged in pairs and essentially symmetrical with respect to a longitudinal axis of the racket, wherein a dampening layer is provided in an area between four o'clock and six o'clock and a further dampening layer in an area between six o'clock and eight o'clock on the racket head, and wherein the dampening layers are wrapped into hollow-profile layers forming the hollow profile.

18. The process according to claim 17, wherein a plurality of strips of the dampening material together form the dampening layer.

19. The process according to claim 18, wherein the strips are arranged so as to essentially extend parallel with respect to each other.

20. The process according to claim 17, wherein the dampening material is wound under an angle ranging between 0° and 45° with respect to the longitudinal direction of the frame.

21. The process according to claim 17, wherein the frame is molded in a molding press under the influence of pressure and temperature.

22. The process according to claim 17, wherein at least one dampening layer is provided in the heart region of the racket.

* * * * *